US006231057B1

(12) United States Patent
Reuss et al.

(10) Patent No.: US 6,231,057 B1
(45) Date of Patent: May 15, 2001

(54) HIGHBACK WITH AN ADJUSTABLE SHAPE

(75) Inventors: Stefan Reuss; Brian D. West, both of Burlington; David J. Dodge, Williston, all of VT (US); Christopher M. Doyle, Santa Fe, NM (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/169,455

(22) Filed: Oct. 9, 1998

(51) Int. Cl.[7] ..... A63C 9/00

(52) U.S. Cl. ..... 280/14.21; 280/607

(58) Field of Search ..... 280/14.21, 623, 280/11.3, 14.22, 634, 617, 607; 36/118.2, 118.3, 118.5, 118.7, 118.8, 118.9, 119, 115

(56) References Cited

U.S. PATENT DOCUMENTS

| | | | |
|---|---|---|---|
| 3,807,060 | 4/1974 | Hanson et al. | 36/2.5 |
| 3,945,135 | 3/1976 | Hanson et al. | 36/2.5 |
| 4,281,468 | 8/1981 | Giese et al. . | |
| 4,907,354 | 3/1990 | Benoit et al. | 36/119 |
| 5,216,826 | 6/1993 | Chaigne et al. | 36/117 |
| 5,401,041 | 3/1995 | Jespersen | 280/14.2 |
| 5,505,477 | 4/1996 | Turner et al. . | |
| 5,556,123 | 9/1996 | Fournier . | |
| 5,664,344 | 9/1997 | Marmonier . | |
| 5,690,350 | 11/1997 | Turner et al. . | |
| 5,701,689 | 12/1997 | Hansen et al. . | |
| 5,713,587 | 2/1998 | Morrow et al. | 280/14.2 |
| 5,727,797 | 3/1998 | Bowles . | |
| 5,771,609 | 6/1998 | Messmer . | |
| 5,815,953 | 10/1998 | Kaufman et al. | 36/118.3 |
| 5,832,635 | 11/1998 | Finney . | |
| 5,975,557 | 11/1999 | Snoke et al. | 280/624 |
| 5,979,082 | 11/1999 | Pallatin | 36/118.2 |

FOREIGN PATENT DOCUMENTS

| | | |
|---|---|---|
| 677 313 A5 | 5/1991 | (CH) . |
| 41 25 224 A1 | 4/1992 | (DE) . |
| 297 00 631 U | 7/1997 | (DE) . |
| 297 00 632 U1 | 7/1997 | (DE) . |
| 297 00 738 U | 7/1997 | (DE) . |
| 0 317 764 A2 | 5/1989 | (EP) . |
| 0724851 | 8/1996 | (EP) . |
| 0 749 702 | 12/1996 | (EP) . |
| 0 753 269 | 1/1997 | (EP) . |
| 0 838 248 A1 | 4/1998 | (EP) . |
| WO 94/03079 | 2/1994 | (WO) . |
| WO 97/28858 | 8/1997 | (WO) . |
| WO 97/32496 | 9/1997 | (WO) . |
| WO 97/35494 | 10/1997 | (WO) . |
| WO 98/31247 | 7/1998 | (WO) . |

*Primary Examiner*—Richard M. Camby
(74) *Attorney, Agent, or Firm*—Wolf, Greenfield & Sacks P.C.

(57) ABSTRACT

A highback for controlling a gliding board, such as a snowboard, through leg movement of a rider. The highback is provided with shape adjustability for accommodating a rider's particular riding preferences. Shape adjustability may allow the rider to reduce pressure points between the highback and the leg, particularly the calf muscle, for increased comfort while maintaining proper heelside support for board control. Shape adjustability may also allow the rider to selectively increase or decrease force transmission and board response based on individual riding preferences and/or riding conditions. The highback may employ one or more sections that may be selectively arranged to achieve a desirable highback shape for board response and rider comfort. The highback may be rigidly fixed in the selected shape to maintain comfort while delivering desired power transmission to the board.

58 Claims, 7 Drawing Sheets

HIGHBACK WITH AN ADJUSTABLE SHAPE

BACKGROUND OF THE INVENTION

1. Field of the Invention

The present invention relates generally to a highback for gliding sports and, more particularly, to a highback with an adjustable shape.

2. Description of the Related Art

Specially configured boards for gliding along a terrain are known, such as snowboards, snow skis, water skis, wake boards, surf boards and the like. For purposes of this patent, "gliding board" will refer generally to any of the foregoing boards as well as to other board-type devices which allow a rider to traverse a surface. For ease of understanding, however, and without limiting the scope of the invention, the inventive highback to which this patent is addressed is disclosed below particularly in connection with a soft snowboard boot and binding that is used in conjunction with a snowboard. It should be appreciated, however, that the present invention described below can be used in association with other types of gliding boards, as well as other types of boots, such as hybrid boots which combine various aspects of hard and soft boots.

Snowboard binding systems for soft snowboard boots typically include an upright member, called a "highback" (also known as a "lowback" and a "skyback"), that supports the rear lower portion of a rider's leg. The highback acts as a lever that helps transmit forces directly to and from the board, allowing the rider to efficiently control the board through leg movement. For example, flexing one's legs rearward against the highback places the board on its heel edge with a corresponding shift in weight and balance acting through the highback to complete a heelside turn.

Board control may be affected by the overall shape, including the height, of a highback. For example, as the height of the highback increases, its force transmission increases resulting in more responsive board control. Conversely, as the height of the highback decreases, its power transmission decreases resulting in less responsive board control. Additionally, as the contact surface area increases between the highback and leg, power transmission increases for more responsive riding.

The shape of the highback may also affect a rider's comfort level when riding by increasing or decreasing the amount of contact surface area between the highback and leg. In particular, a highback may create undesirable pressure points against a rider's leg, rather than apply a uniform pressure distribution across the boot and leg. For example, the upper portion of a highback may engage the calf muscle of a rider, thereby creating a gap between the highback and the lower portion of the rider's leg below the calf muscle. This situation concentrates much of the force between the highback and the rider's leg onto the calf muscle, a condition riders generally find uncomfortable.

While it is desirable for a highback to deliver optimal performance, Applicants recognize that variable factors, including boot shape, leg shape, rider ability and rider sensitivity, tend to preclude a specific highback from providing optimal performance for every rider by failing to provide one or more particular characteristics desired by some riders. Consequently, a rider may employ a highback having less preferable characteristics to gain other more desirable characteristics in its overall performance. For example, many riders, particularly experienced and aggressive riders, may choose to use a tall, closely contoured highback that may be responsive but less comfortable, while other riders may choose to use a shorter or less contoured highback that may be more comfortable but less responsive. Tall highbacks tend to contact the calf muscle of shorter riders, such as women, creating undesirable pressure points on the leg. Accordingly, riders may prefer a degree of adjustability in the highback shape for achieving a desirable balance between various highback characteristics, such as power transmission to the board and pressure distribution on the leg during heelside maneuvers.

It is an object of the present invention to provide an improved highback having an adjustable shape for selective force transmission and riding comfort.

SUMMARY OF THE INVENTION

In one illustrative embodiment of the invention, a highback is provided for use with a component, such as a gliding board binding, a boot or a binding interface, that interfaces with a rider's leg and is supportable by a gliding board. The highback comprises a highback body that includes an upright back member to support a rear portion of a rider's leg. The highback body has a contoured shape that is adjustable between a first fixed shape with a first contour and a second fixed shape with a second contour that is different from the first fixed shape. The highback body is constructed and arranged for engagement with the component.

In another illustrative embodiment of the invention, a highback is provided for use with a snowboard component that interfaces with a rider's leg and is supportable by a snowboard. The highback comprises a highback body that includes an upright back member to support a rear portion of a rider's leg. The back member has a contoured shape that is adjustable between a first fixed shape with a first contour and a second fixed shape with a second contour that is different from the first fixed shape. The back member includes a lower portion with a heel cup configured to hold a heel portion of a snowboard boot and at least one section supported on the lower portion. The at least one section is flexible relative to the lower portion along a flex zone defined in part by at least one aperture extending through the back member to adjust the contoured shape of the back member. The highback body is constructed and arranged to be supported on the snowboard component.

The highback may also include a rigid link adjustably coupling the at least one section to the lower portion to selectively maintain the at least one section in one of a first position and a second position relative to the lower portion to fix the contoured shape in one of the first fixed shape and the second fixed shape. The highback may further include a pair of lateral arms extending from opposing sides of the back member to pivotally mount the highback to the snowboard device.

BRIEF DESCRIPTION OF THE DRAWINGS

The invention will be appreciated more fully with reference to the following detailed description of illustrative embodiments thereof, when taken in conjunction with the accompanying drawings, wherein like reference characters denote like features, in which.

DETAILED DESCRIPTION

The present invention is directed to a highback that is provided with shape adjustability for accommodating a rider's particular riding preferences. Shape adjustability may allow the rider to reduce pressure points between the highback and the leg, particularly the calf muscle, for increased comfort while maintaining proper heelside support for board control. Shape adjustability may also allow the rider to selectively increase or decrease force transmission and board response based on individual riding preferences and/or riding conditions. The highback may employ one or more sections that may be selectively arranged to achieve a desirable highback shape for board response and rider comfort. Since increased highback flexibility reduces board response, an effect many riders find undesirable, the highback may be rigidly fixed in the selected shape to maintain comfort while delivering desired power transmission to the board.

Figure 1:
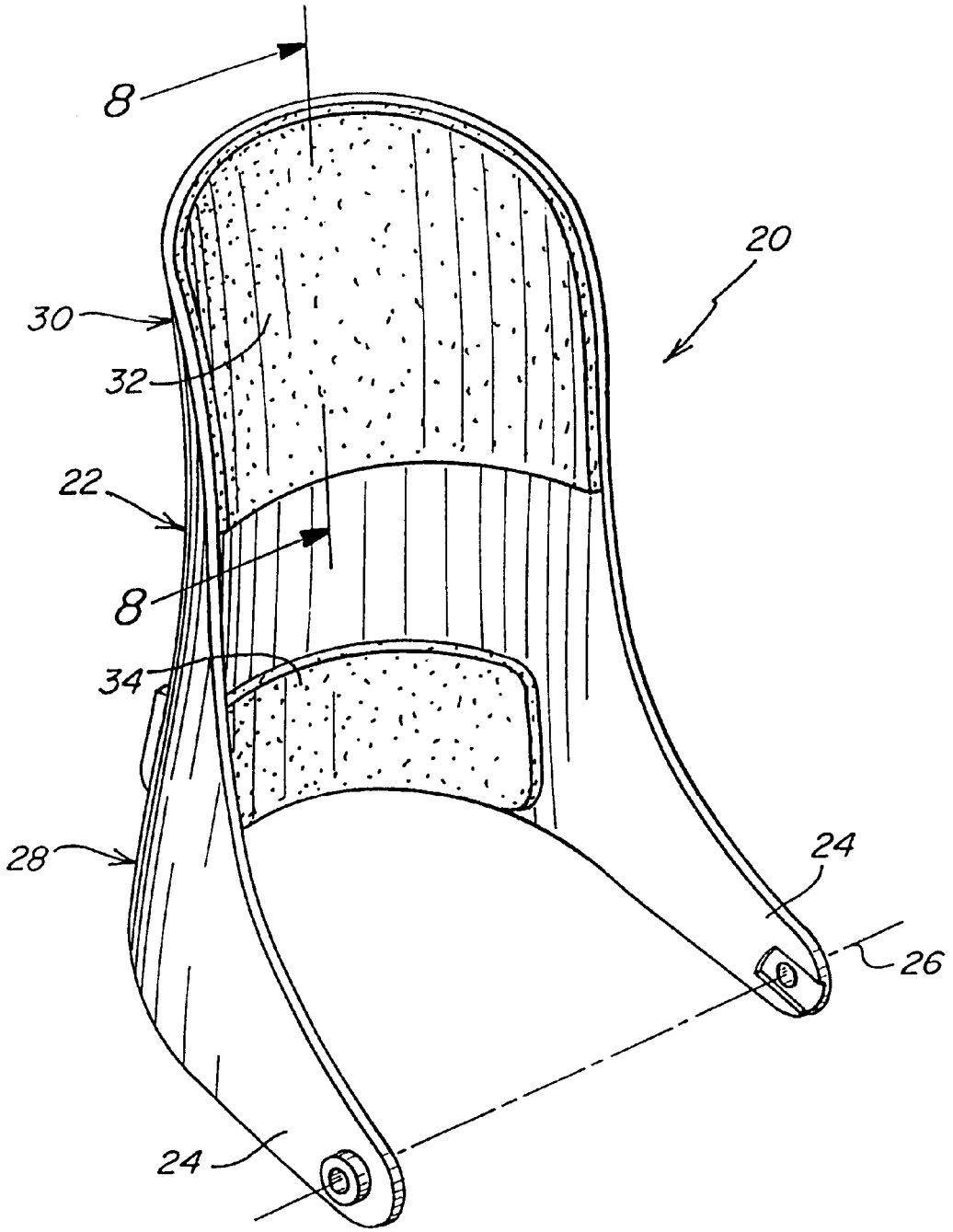
FIG. 1 is a perspective view of the highback with an adjustable shape according to one illustrative embodiment of the invention.

In one illustrative embodiment as shown in FIG. 1, the highback 20 includes an upright back member 22 and a pair of lateral arms 24 that extend from opposing sides of the back member. The lateral arms 24 may be employed to pivotally attach the highback 20 to a snowboard component, such as a snowboard binding or a snowboard boot, along a mounting axis 26 that is transverse to the length of the binding or boot.

The back member 22 preferably has a contoured configuration that is generally compatible with the shape of a boot. The highback 20 includes a heel cup 28 at a lower portion of the back member 22 that is configured to grip and hold the heel portion of the boot. The back member 22 transitions from the heel cup 28 to an upper portion 30 of the highback that is configured to extend along the rear portion of the rider's leg to provide heelside support for turning and controlling the board. The inner surface of the highback may include resilient pads 32, 34 to increase heel hold, to absorb shock and to facilitate pressure distribution across the boot and leg.

In one illustrative embodiment of the invention, the upper portion 30 of the highback is adjustable relative to the lower portion or heel cup 28 to relieve pressure points between the highback and an individual's calf muscle without sacrificing overall ride performance. The contoured shape of the upper portion 30 may be selectively adjusted to increase contact between the back member and the rider's leg, thereby increasing highback leverage, while avoiding the creation of pressure points on the calf muscle. Conversely, the upper portion 30 may be adjusted to decrease surface contact with the rider's leg to reduce highback leverage.

Figure 2:
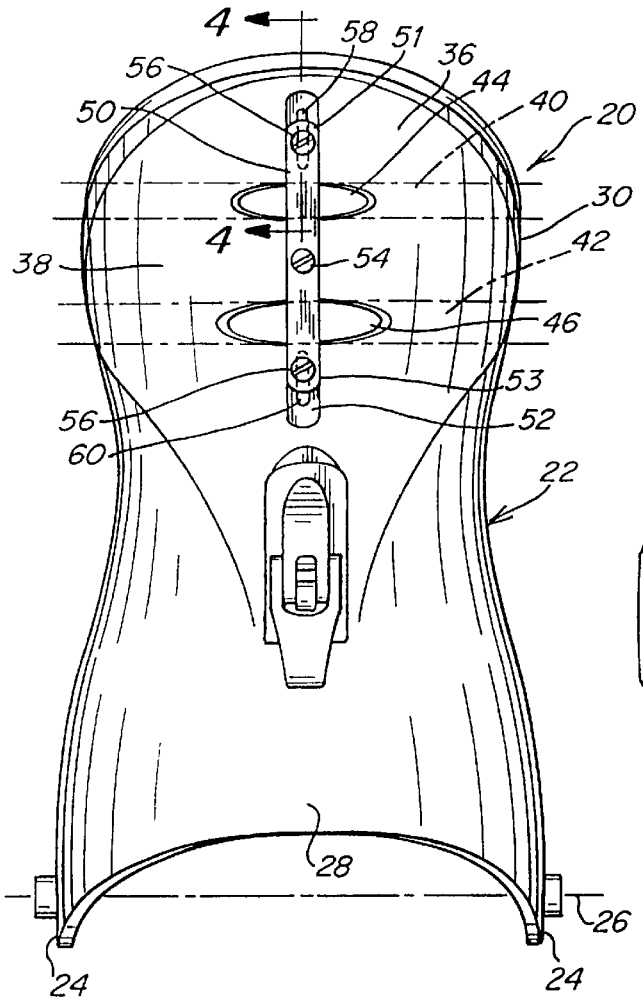
FIG. 2 is a rear view of the highback of FIG. 1 illustrating one embodiment of a shape adjustment mechanism.
Figure 3:
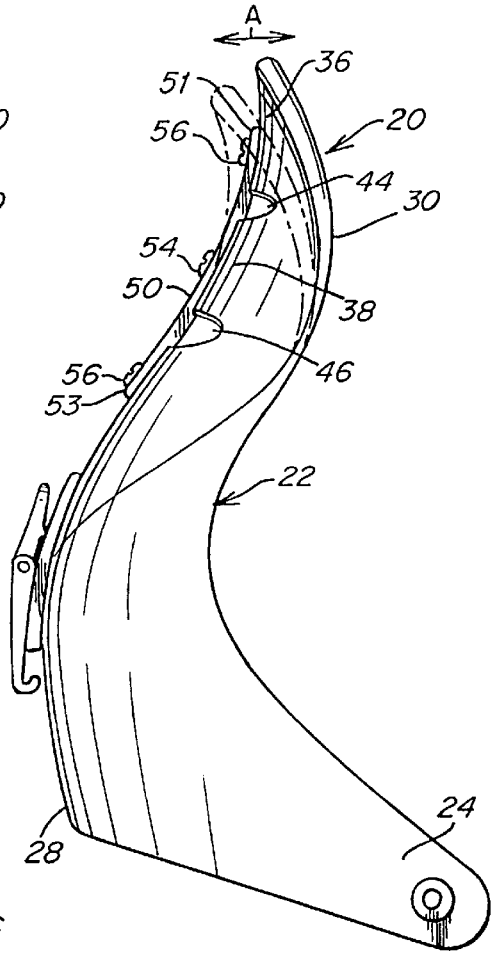
FIG. 3 is a side elevational view of the highback of FIGS. 1–2.

The highback 20 may include one or more sections in its upper portion that may be arranged relative to the heel cup 28 to provide the rider with a desired highback contour. As illustrated in FIGS. 2–3, the upper portion 30 of the highback may include first and second adjustable sections 36, 38 that can be flexed relative to the heel cup 28. As illustrated, the upper portion 30 of the highback may be flexed between a first fixed shape (solid lines) and a second fixed shape (phantom lines). This arrangement allows the rider to adjustably shape the upper portion 30 of the highback with a contour that is conducive to the rider's individual riding preferences. The degree and direction of flex may be defined by flex zones 40, 42 formed in the back member. As illustrated, the flex zones 40, 42 may extend generally parallel to the mounting axis 26 of the highback to allow the sections 36, 38 to flex in a toe-to-heel direction A. It is to be appreciated, however, that the highback may be configured to allow adjustment of the shape in any direction as would be apparent to one of skill in the art. For example, one or more flex zones may be provided transverse to or in multiple directions relative to the mounting axis.

The overall shape of the highback may be established by the number and size of the sections 36, 38. For example, as the height of each section decreases and the number of sections increases, the rider may be capable of creating a smoother, more precisely defined contour for the upper portion. Consequently, it is to be appreciated that the number and size of the sections are not limited to the illustrative embodiment shown in the figures.

The highback may be flexed into its desired shape by reducing the stiffness of the back member 22 at predetermined locations. In the illustrative embodiment, first and second apertures 44, 46 extend across the back member 22 to form the flex zones 40, 42. Although generally oval-shaped apertures 44, 46 are shown, any suitably configured aperture may be employed to achieve the desired flexibility characteristics necessary for shaping the highback. It is to be appreciated, however, that highback flexibility may be implemented in any other suitable manner apparent to one of skill in the art. For example, rather than or in addition to apertures, the flexibility of the highback may be increased or decreased by varying the thickness or the surface texture of the back member 22 at selected locations. The flexibility may also be established using various structural members or reliefs, such as ribs or grooves. Highback flexibility may also be achieved employing materials of varying characteristics at selected portions of the highback.

Since the degree of highback flexibility affects power transmission and board response, an adjustment mechanism may be provided for rigidly securing the highback in a desired configuration. In one illustrative embodiment, the adjustment mechanism includes a rigid link 50, such as an elongated bar, rod, strap or the like, that may be mounted within a groove 52 along the upper portion 30 of the back member. The intermediate portion of the link 50 may be fixed between the first and second sections 36, 38 using any suitable fastener 54, such as a rivet, screw or the like. The opposing ends of the link 50 may be adjustably secured to the highback using any suitable fastener 56, such as a screw, removable pin or the like, that extends through the link and corresponding slots 58, 60 in the highback.

As illustrated, the first end 51 of the link 50 is slidably secured above the first aperture 44 and the second end 53 of the link 50 is slidably secured below the second aperture 46. With the intermediate portion of the link 50 fixed to the highback between the first and second apertures, the first and second sections 36, 38 may be selectively arranged and locked to maintain the highback in one of at least two contoured shapes.

The highback shape may be adjusted by loosening one or both of the fasteners 56 to allow the rider to selectively position the sections 36, 38 relative to the heel cup 28. The rider flexes the sections 36, 38, either individually or together, along their respective flex zones 40, 42 into a configuration that gives the highback upper portion 30 a desired shape. Once the shape is established, the fasteners 56 are tightened so that the link 50 maintains the upper portion 30 in the selected shape.

Figure 4:
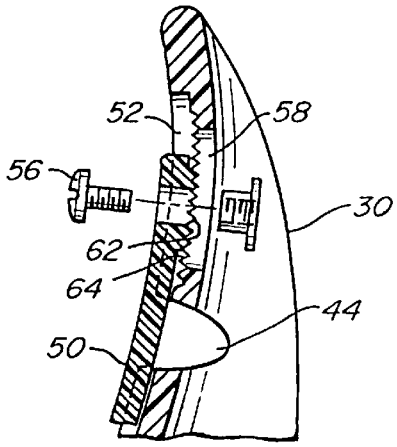
FIG. 4 is a cross-sectional view taken along section line 4—4 of FIG. 2 illustrating one embodiment of an interlock for the shape adjustment mechanism.

Since a highback can be subjected to large forces during heelside maneuvers, the highback adjustment mechanism may be provided with an interlock that maintains the upper portion of the highback in its selected configuration. In one illustrative embodiment shown in FIG. 4, the link 50 may include a plurality of interlocking features 62, such as teeth, splines or the like, that mate with corresponding features 64 located adjacent the adjustment slots 58, 60 of the highback. When the fasteners 56 are tightened, the interlocking features on the link 50 and the highback upper portion 30 are drawn together to maintain the highback shape. Alternatively, multiple adjustment holes may be provided in the highback 20, the link 50 or both for receiving the fasteners. It is to be understood, however, that any suitable interlock apparent to one of skill in the art may be employed to maintain the highback in its selected shape.

The highback 20 is preferably molded from a rigid plastic material, such as polycarbonate, polyolefin, polyurethane, polyethylene and the like, that is capable of providing efficient force transmission from the rider to the board. The link 50 is preferably molded from a rigid material, such as a glass-filled nylon. It is to be appreciated, however, that the highback and link may be formed from any suitable material apparent to one of skill in the art.

Figure 5:
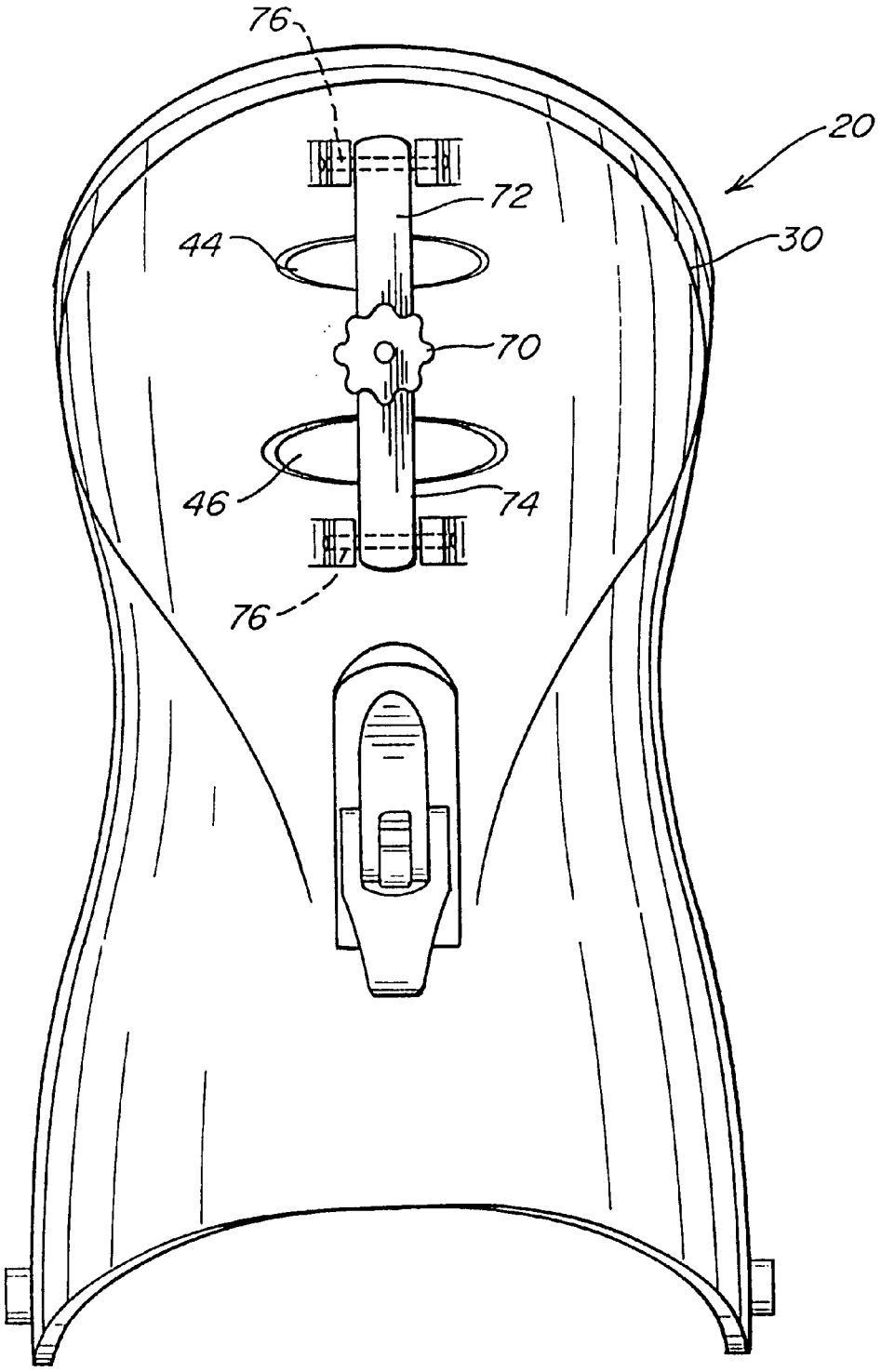
FIG. 5 is a rear view of the highback according to another embodiment of the invention illustrating an alternate shape adjustment mechanism.

In another embodiment, the shape of the highback may be adjusted using an adjustment mechanism that is coupled to the adjustable sections with one or more links. As illustrated in FIG. 5, an actuator 70, such as a rotatable knob, may be mounted to the rear of the upper portion 30 of the highback. First and second links 72, 74 interconnect the knob 70 to the highback in any suitable manner apparent to one of skill so that rider actuation of the knob flexes the upper portion into a desired shape. In one embodiment, the ends of the links may be pivotally connected to the highback using any suitable fastener 76, such as a pin.

A snowboard rider's legs are generally held by the highback at a forward angle relative to the board for balance, control and to ensure the rider's knees are bent for better shock absorption, particularly when landing jumps. To hold the rider's legs in such a stance, the highback is typically inclined relative to the board in a position referred to as "forward lean". The particular forward lean angle of the highback relative to the board may be selectively adjusted by the rider for comfort, control and one's particular riding style.

As the amount of forward lean increases, the highback becomes angled more aggressively toward the rider's leg so that the upper portion, particularly its upper edge, may create a pressure point against the rider's leg. To account for forward lean variations, a forward lean compensation arrangement may be provided for adjusting the shape of the highback in relation to the amount of forward lean.

Figure 6:
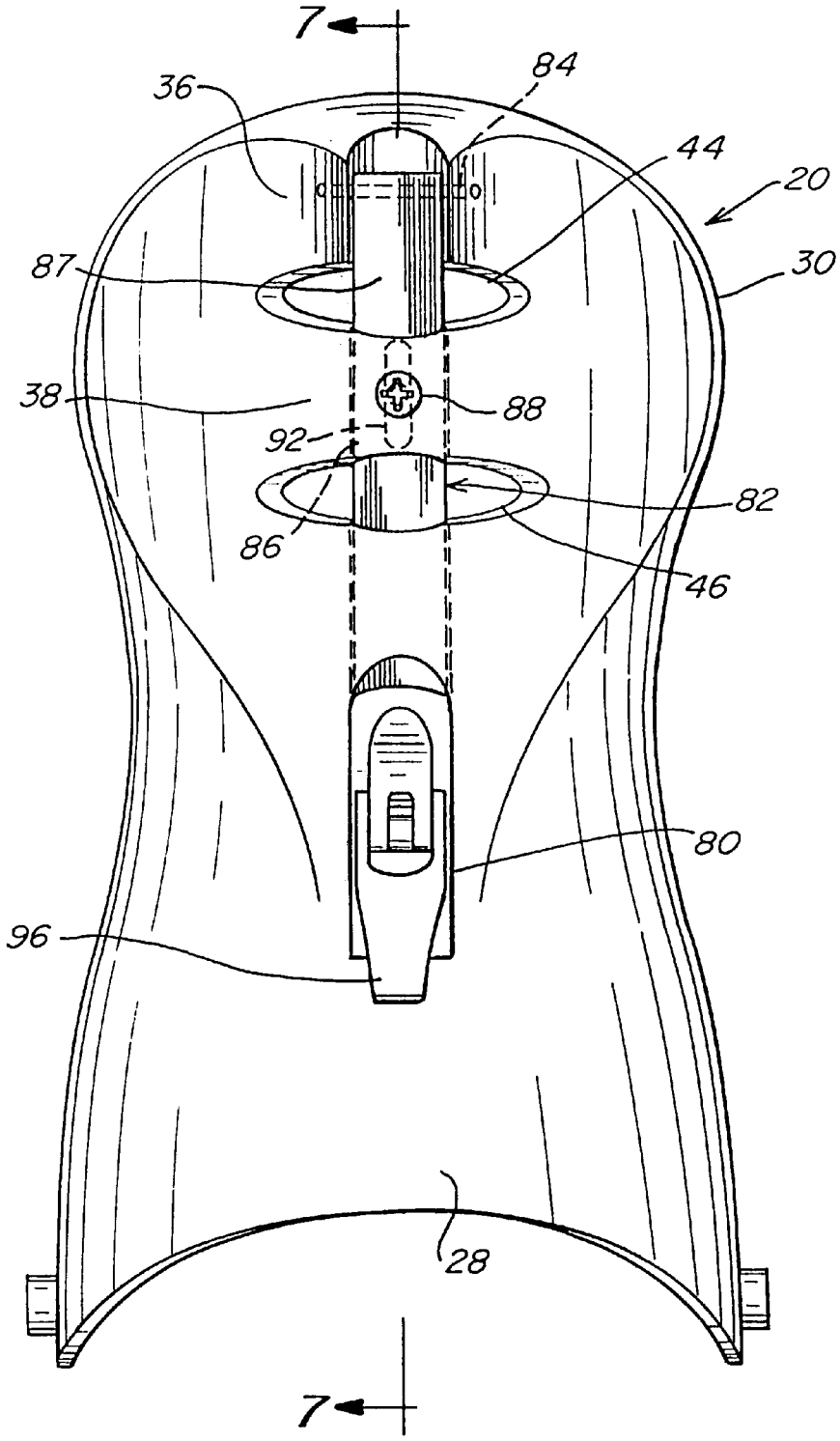
FIG. 6 is a rear view of the highback according to a further embodiment of the invention illustrating another shape adjustment mechanism.
Figure 7:
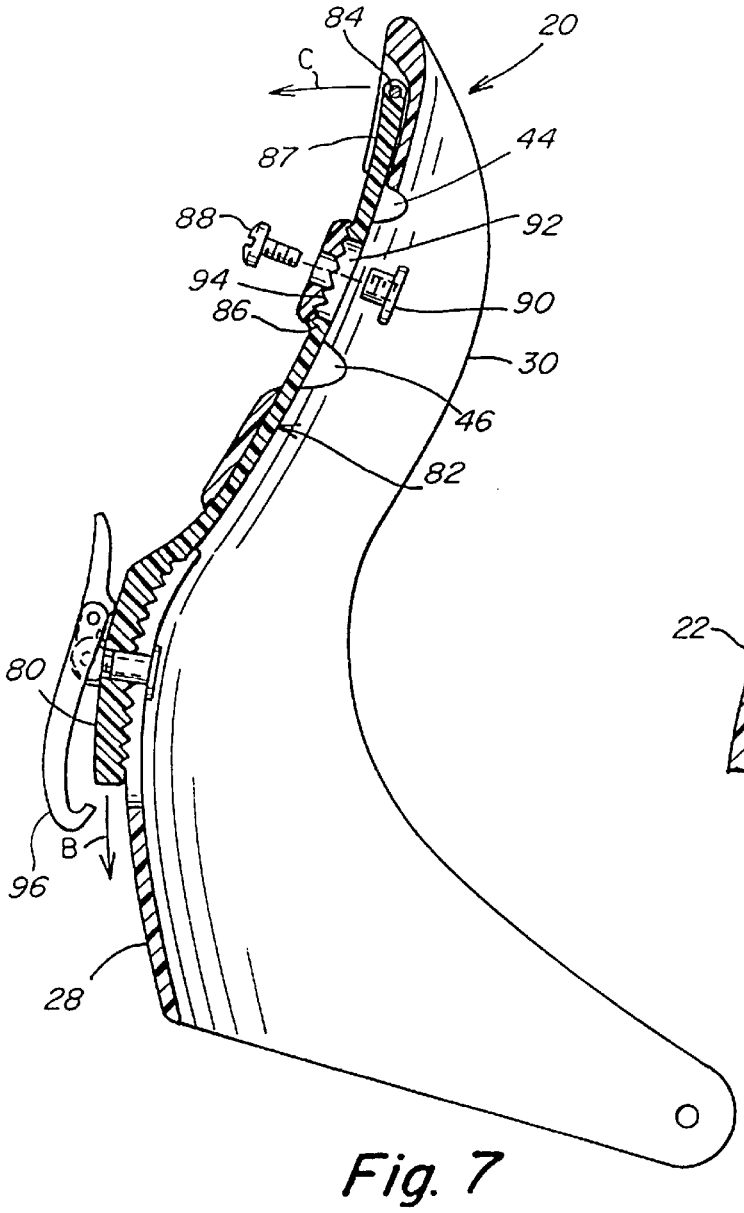
FIG. 7 is a cross-sectional view taken along section line 7—7 of FIG. 6.

In one illustrative embodiment shown in FIGS. 6–7, forward lean compensation may be incorporated into the highback by coupling the upper portion 30 of the highback to a forward lean adjuster 80, which allows the rider to preselect the forward lean angle of the highback relative to the board, with a link 82, such as a strap or the like. The upper end of the link 82 may be pivotally connected to the first section 36, such as with a pin 84 or other suitable fastener, and the lower end of the link 82 may be connected to the forward lean adjuster 80.

As the position of the forward lean adjuster 80 is adjusted relative to the heel cup 28 to select a desired forward lean, the link 82 acts on the highback upper portion 30 to adjust its shape. For example, as forward lean is increased by moving the adjuster 80 in a downward direction B toward the heel cup 28, the link 82 draws the upper portion 30 of the highback downwardly flexing the sections 36, 38 toward the heel cup 28 in a direction C away from the rider's leg.

The forward lean compensation arrangement may be configured to allow the rider to configure the upper portion for a particular forward lean with subsequent shape adjustment occurring during forward lean adjustment. As shown in FIGS. 6–7, the initial shape of the highback may be fixed by securing an intermediate portion 86 of the link 82 to the highback so that the upper portion 87 of the link 82 between its upper end and the intermediate portion 86 rigidly maintains the first section 36 of the highback in a desired configuration. The intermediate portion 86 of the link may be adjustably secured with a fastener, such as a screw 88 and nut 90 arrangement, that passes through the upper portion of the highback between the first and second apertures 44, 46 and an elongated slot 92 in the link. The intermediate portion 86 of the link may include a plurality of teeth 94 or other suitable interlock that securely mates with a corresponding feature on the highback to securely maintain the selected shape between the first and second sections. Subsequent adjustment of the forward lean adjuster 80 causes the lower portion of the link to adjust the second section 38 of the highback relative to the heel cup 28 in relation to the amount of forward lean adjustment, as described above.

The forward lean adjuster 80 may include an adjustable block that is slidably attached to the rear of the highback for quick and convenient forward lean adjustment. It should be understood, however, that the forward lean may be adjusted using any suitable adjustment means apparent to one of skill. For example, the block and/or the highback may include multiple mounting holes that allow selective positioning of the block on the highback. The forward lean adjuster may also include a latch 96 to lock down and prevent the highback from rotating forward for enhanced toeside response.

Figure 8:
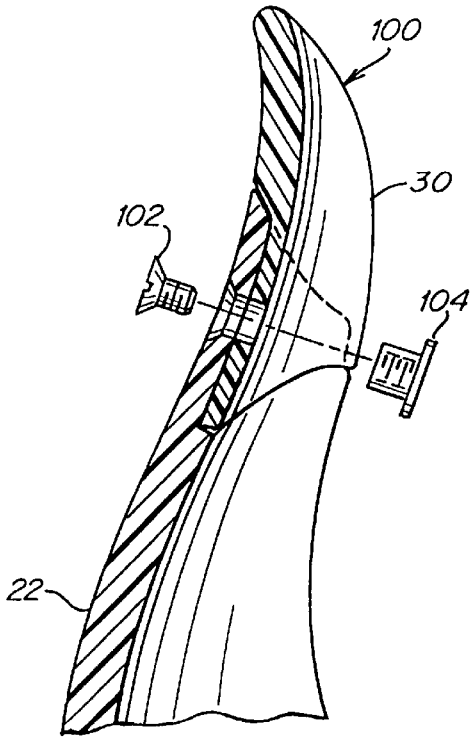
FIG. 8 is a cross-sectional view taken along section line 8—8 of FIG. 1 illustrating a further embodiment for adjusting the highback shape.

In another illustrative embodiment of the invention, the shape of the highback 20 may be adjusted using a plurality of interchangeable highback uppers, each having a shape that differs from the other uppers. The uppers may be provided with shapes having varying curvatures, heights and/or any other feature apparent to one of skill. As illustrated in FIG. 8, the back member 22 of the highback may detachably support any one of the interchangeable uppers 100 to provide a desired highback shape. The uppers 100 may be detachably connected to the highback using any suitable fastener apparent to one of skill, such as a screw 102 and nut 104 arrangement.

The adjustable highback according to the present invention may be employed in any gliding board activity, such as snowboarding, that would benefit from heelside support. For ease of understanding, however, and without limiting the scope of the invention, the inventive highback is now described below in connection with a snowboard binding.

Figure 9:
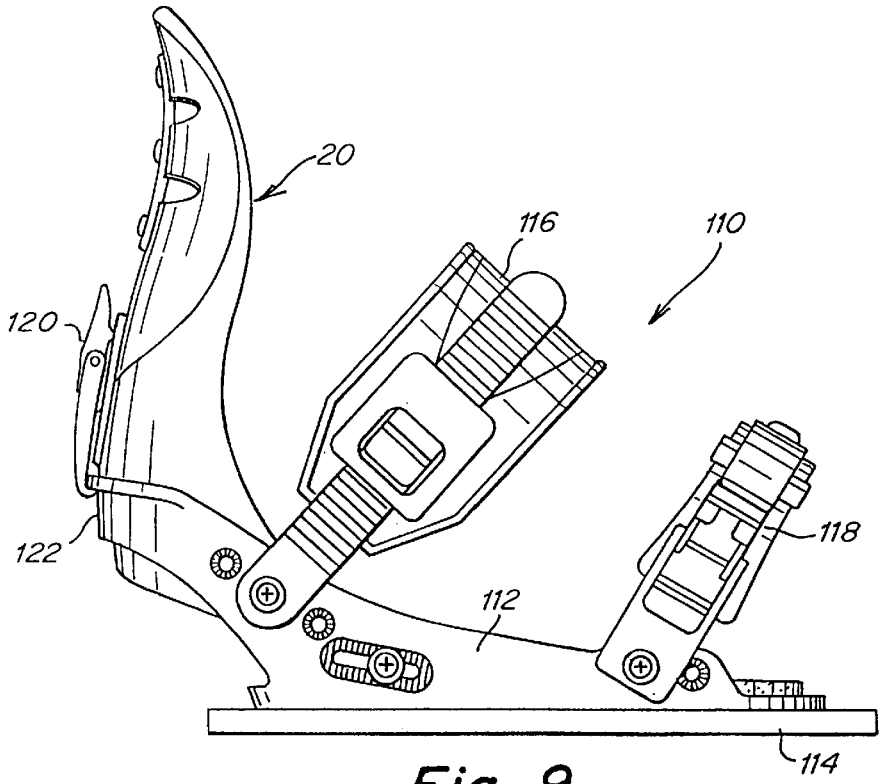
FIG. 9 is a side view of the highback incorporated with an illustrative embodiment of a snowboard binding according to another aspect of the invention.

In an illustrative embodiment shown in FIG. 9, the snowboard binding 110 may include a baseplate 112, which is mountable to a snowboard 114, and one or more binding straps, preferably adjustable straps, that are attached to the baseplate for securing a boot (not shown) to the snowboard. The highback 20 is pivotally mounted to the sidewalls of the baseplate 112. As illustrated, the binding 110 may include an ankle strap 116 that extends across the ankle portion of the boot to hold down the rider's heel and a toe strap 118 that extends across and holds down the front portion of the boot. It is to be understood, however, that the binding 110 may implement other strap configurations. A lockdown forward lean adjuster 120 may also be provided to interact with a heel hoop 122 for setting the highback 20 at a preselected forward lean angle relative to the board and to lock down the highback for enhanced toeside response.

The highback 20 of the present invention, however, is not limited to any particular type of binding. For example, the highback may also be implemented with a step-in snowboard binding that includes a locking mechanism that engages corresponding features provided, either directly or indirectly, on a snowboard boot. The highback may be mounted to a binding baseplate in a manner similar to the binding described above. Examples of step-in snowboard bindings that may incorporate the flexible highback are described in U.S. Pat. No. 5,722,680 and U.S. patent application Ser. No. 08/780,721, which are incorporated herein by reference.

Figure 10:
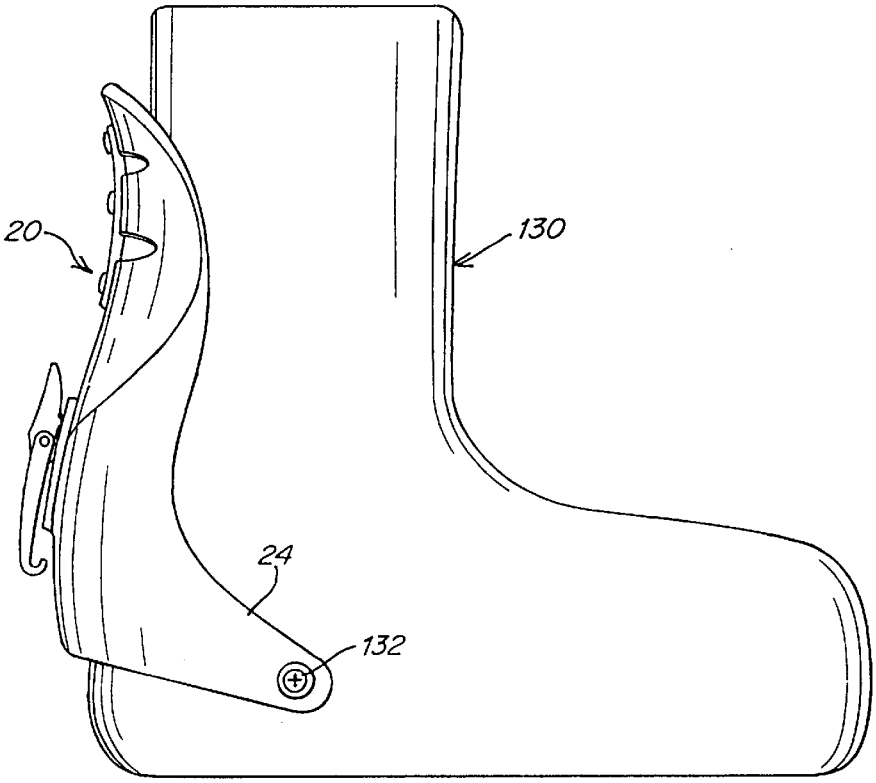
FIG. 10 is a side view of the highback incorporated with an illustrative embodiment of a snowboard boot system according to a further aspect of the invention.

In another embodiment, the highback 20 of the present invention may be either permanently attached to or removable from a snowboard boot. A removable highback provides system flexibility by allowing the boot to be implemented with binding systems that already include a highback mounted to a binding baseplate. As illustrated in FIG. 10, the highback 20 is movably mounted to the heel region of a boot 130. The lateral arms 24 are preferably attached below the ankle portion of the boot for facilitating lateral or side-to-side boot flexibility that allows desirable lateral foot roll. The lateral arms 24 may be attached to the boot, preferably at reinforced attachment points, using any suitable fastener 132, such as a screw, rivet or the like, that passes through each lateral arm.

In another aspect of the invention, the flexible highback 20 may be implemented with a detachable binding interface system for interfacing a boot to a binding. As illustrated in one embodiment shown in FIG. 11, the interface 140 includes a body 142 and at least one adjustable strap 144 that is arranged to be disposed across the ankle portion of the boot 146, which is shown in phantom. The highback 20 is movably mounted to the sidewalls of the interface body 142 using a suitable fastener 145 that passes through the lateral arms 24 of the highback. The body 142 of the interface may include one or more mating features 148, as would be apparent to one of skill in the art, that are adapted to engage corresponding engagement members 150 on the binding 152.

Figure 11:
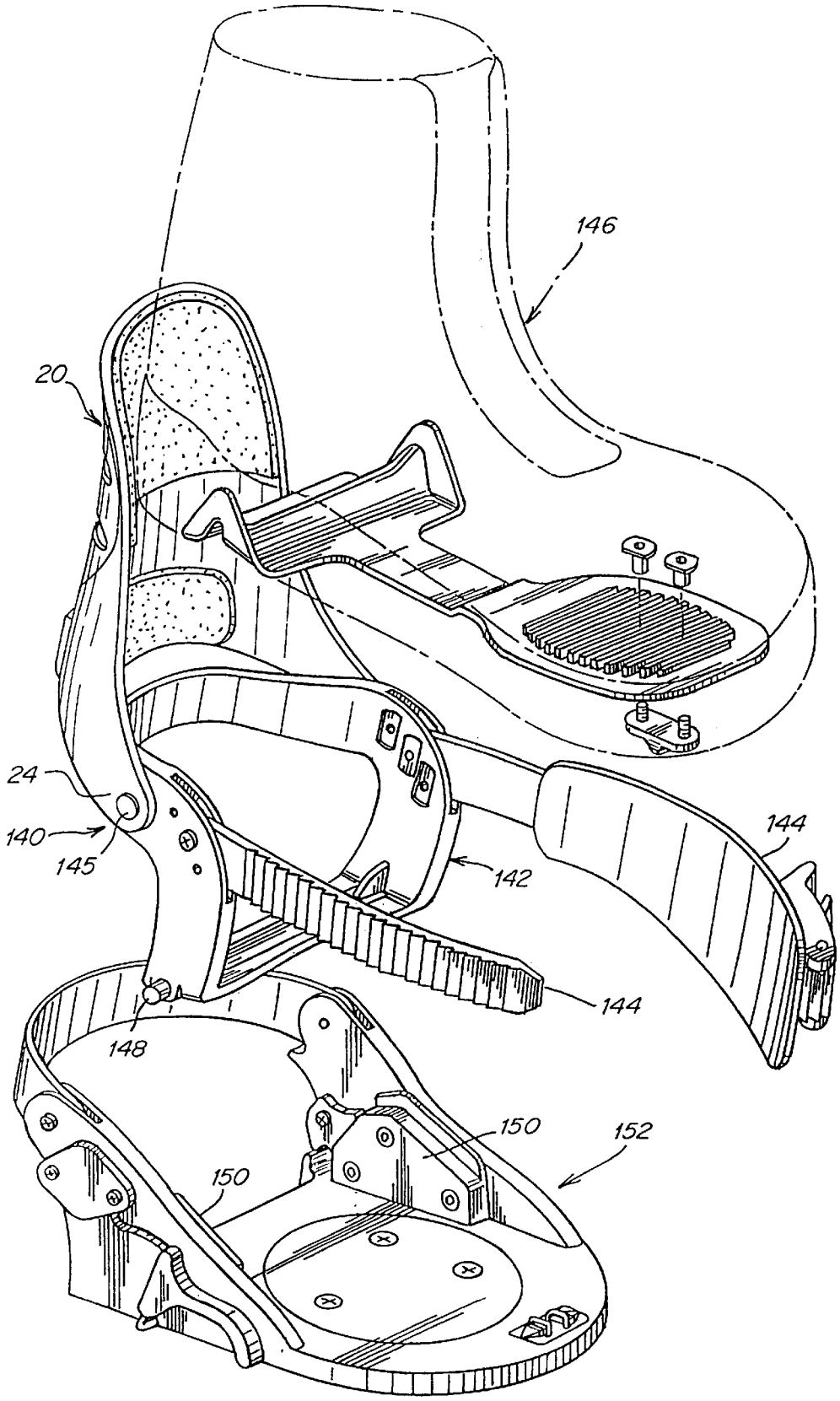
FIG. 11 is a perspective view of the highback incorporated with an illustrative embodiment of a detachable binding interface according to another aspect of the invention.

The particular binding interface 140 and binding 152 shown in FIG. 11 is described in greater detail in a U.S. application Ser. No. 09/062,131, which is incorporated herein by reference.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the following claims and their equivalents.

What is claimed is:

1. A highback for use with a component that interfaces with a rider's leg and is supportable by a gliding board, the highback comprising:

a highback body including an upright back member having a contoured shape to support a rear portion of a rider's leg, the highback body having a contoured shape that is adjustable between a first fixed shape with a first contour and a second fixed shape with a second contour that is different from the first fixed shape, the highback body constructed and arranged to be mounted to the component; and a forward lean adjuster mounted to the highback body, the forward lean adjuster constructed and arranged to engage a portion of a binding to set the highback at a preselected forward lean position relative to the gliding board.

2. The highback recited in claim 1, wherein the back member includes a lower portion with a heel cup and at least one section adjustably supported on the lower portion.

3. The highback recited in claim 2, wherein the at least one section is flexibly supported on the lower portion of the back member above the heel cup.

4. The highback recited in claim 3, wherein the highback further includes a pair of lateral arms extending from opposing sides of the back member, the lateral arms being constructed and arranged to pivotally mount the highback to the gliding board component along a mounting axis, the at least one section being flexibly supported along a flex zone that is generally parallel to the mounting axis.

5. The highback recited in claim 3, wherein the at least one section is adjustable in a toe-to-heel direction between the first and second fixed shapes.

6. A highback for use with a component that interfaces with a rider's leg and is supportable by a gliding board the highback comprising:

a highback body including an upright back member having a contoured shape to support a rear portion of a rider's leg, the highback body having a contoured shape that is adjustable between a first fixed shape with a first contour and a second fixed shape with a second contour that is different from the first fixed shape, the highback body being constructed and arranged for engagement with the component;

wherein the back member includes a lower portion with a heel cup and at least one section adjustably supported on the lower portion;

wherein the at least one section is flexibly supported on the lower portion of the back member above the heel cup; and wherein the at least one section is flexible relative to the lower portion of the back member along a flex zone formed in part by at least one aperture extending through the back member.

7. The highback recited in claim 6, wherein the at least one aperture has a generally oval shape extending across the back member.

8. The highback recited in claim 2, wherein the highback includes an adjustment mechanism to maintain the at least one section in one of a first fixed position and a second fixed position relative to the lower portion to fix the contoured shape in one of the first fixed shape and the second fixed shape.

9. A highback for use with a component that interfaces with a rider's leg and is supportable by a gliding board, the highback comprising:

a highback body including an upright back member having a contoured shape to support a rear portion of a rider's leg, the highback body having a contoured shape that is adjustable between a first fixed shape with a first contour and a second fixed shape with a second contour that is different from the first fixed shape, the highback body being constructed and arranged for engagement with the component;

wherein the back member includes a lower portion with a heel cup and at least one section adjustably supported on the lower portion;

wherein the highback includes an adjustment mechanism to maintain the at least one section in one of a first fixed position and a second fixed position relative to the lower portion to fix the contoured shape in one of the first fixed shape and the second fixed shape; and wherein the adjustment mechanism includes at least one rigid link coupled to the at least one section and the lower portion.

10. The highback recited in claim 9, wherein at least one end of the link is adjustably connected to the back member.

11. The highback recited in claim 10, wherein the at least one end of the link is slidably connected to the back member.

12. The highback recited in claim 9, wherein the adjustment mechanism further includes an actuator mounted to the back member to adjust the at least one section relative to the lower portion.

13. The highback recited in claim 12, wherein the actuator is connected to the link.

14. The highback recited in claim 13, wherein the actuator includes a forward lean adjuster adjustably mounted to the lower portion of the back member, a first end of the link being pivotally connected to the at least one section and a second end of the link being connected to the forward lean adjuster.

15. The highback recited in claim 14, wherein an intermediate portion of the link is adjustably connected to the back member.

16. The highback recited in claim 9, wherein the adjustment mechanism further includes an interlock between the link and the back member to prevent relative movement therebetween.

17. A highback for use with a component that interfaces with a rider's leg and is supportable by a gliding board, the highback comprising:

a highback body including an upright back member having a contoured shape to support a rear portion of a rider's leg, the highback body having a contoured shape that is adjustable between a first fixed shape with a first contour and a second fixed shape with a second contour that is different from the first fixed shape, the highback body being constructed and arranged for engagement with the component;

wherein the at least one section includes a first section having a first shape and a second section having a second shape that is different from the first shape, the first and second sections being interchangeably supported on the back member to adjust the contoured shape between the first and second fixed shapes.

18. The highback recited in claim 1, wherein the gliding board is a snowboard and the gliding board component is a snowboard component.

19. The highback recited in claim 18, in combination with the snowboard component, the highback being mounted on the snowboard component.

20. The highback recited in claim 19, wherein the snowboard component includes a snowboard binding having a baseplate, the highback being pivotally mounted to the baseplate.

21. The highback recited in claim 20, wherein the snowboard binding includes at least one adjustable strap mounted to the baseplate to secure a snowboard boot.

22. The highback recited in claim 20, wherein the snowboard binding is a step-in binding.

23. The highback recited in claim 19, wherein the snowboard component includes a snowboard boot, the highback being pivotally mounted to the snowboard boot.

24. The highback recited in claim 19, wherein the snowboard component includes a detachable binding interface that is constructed and arranged to interface a snowboard boot with a snowboard binding.

25. A highback for use with a component that interfaces with a rider's leg and is supportable by a gliding board, the highback comprising:

a highback body including an upright back member having a contoured shape to support a rear portion of a rider's leg, the highback body having a contoured shape that is adjustable between a first fixed shape with a first contour and a second fixed shape with a second contour that is different from the first fixed shape the highback body being constructed and arranged for engagement with the component;

wherein the highback body further includes a pair of lateral arms extending from opposing sides of the back member for mounting the highback to the component.

26. The highback recited in claim 25, wherein the back member has an inner surface extending between the opposing sides with a generally concave shape.

27. A highback for use with a snowboard component that interfaces with a rider's leg and is supportable by a snowboard, the highback comprising:

a highback body constructed and arranged to be supported on a snowboard component, the highback including, an upright back member constructed and arranged to support a rear portion of a rider's leg, the back member having a contoured shape to support a rear portion of a rider's leg on the snowboard, the contoured shape of the back member being adjustable between a first fixed shape with a first contour and a second fixed shape with a second contour that is different from the first fixed shape, the back member including a lower portion with a heel cup configured to hold a heel portion of a snowboard boot and at least one section supported on the lower portion, the at least one section being flexible relative to the lower portion along a flex zone defined in part by at least one aperture extending through the back member to adjust the contoured shape of the back member;

a link adjustably coupling the at least one section to the lower portion to selectively maintain the at least one section in one of a first position and a second position relative to the lower portion to fix the contoured shape in one of the first fixed shape and the second fixed shape; and a pair of lateral arms extending from opposing sides of the back member to pivotally mount the highback to the snowboard component.

28. The highback recited in claim 27, in combination with the snowboard component, the highback being mounted on the snowboard component.

29. The highback recited in claim 28, wherein the snowboard component includes a snowboard binding having a baseplate, the highback being pivotally mounted to the baseplate.

30. The highback recited in claim 29, wherein the snowboard binding includes at least one adjustable strap mounted to the baseplate to secure a snowboard boot.

31. The highback recited in claim 29, wherein the snowboard binding is a step-in binding.

32. The highback recited in claim 28, wherein the snowboard component includes a snowboard boot, the highback being pivotally mounted to the snowboard boot.

33. The highback recited in claim 28, wherein the snowboard component includes a detachable binding interface that is constructed and arranged to interface a snowboard boot with a snowboard binding.

34. A highback for use with a snowboard component that interfaces with a rider's leg and is supportable by a snowboard, the highback comprising:

a highback body having a contoured shape to support a rear portion of a rider's leg on the snowboard, the highback body constructed and arranged to be mounted on a snowboard component; and means for adjusting the contoured shape of the highback between a first fixed shape with a first contour and a second fixed shape with a second contour that is different from the first fixed shape; and a forward lean adjuster mounted to the highback body, the forward lean adjuster constructed and arranged to engage a portion of a snowboard binding to set the highback at a preselected forward lean position relative to the snowboard.

35. The highback recited in claim 34, further comprising means for maintaining the contoured shape of the highback in one of the first fixed shape and the second fixed shape.

36. The highback recited in claim 1, wherein the forward lean adjuster includes a lockdown feature that is constructed and arranged to lock down the highback to the binding.

37. The highback recited in claim 34, wherein the forward lean adjuster includes a lockdown feature that is constructed and arranged to lock down the highback to the snowboard binding.

38. A snowboard binding to secure a snowboard boot to a snowboard, the snowboard binding comprising:

a baseplate that is constructed and arranged to be mounted to the snowboard; and a highback pivotally mounted to the baseplate, the highback including a highback body with an upright back member having a contoured shape to support a rear portion of a rider's leg, the highback body having a contoured shape that is adjustable between a first fixed shape with a first contour and a second fixed shape with a second contour, wherein the second fixed shape is different from the first fixed shape.

39. The snowboard binding recited in claim 38, wherein the back member includes a lower portion with a heel cup and at least one section adjustably supported on the lower portion.

40. The snowboard binding recited in claim 39, wherein the at least one section is flexibly supported on the lower portion of the back member above the heel cup.

41. The snowboard binding recited in claim 40, wherein the highback further includes a pair of lateral arms extending from opposing sides of the back member, the lateral arms pivotally mounting the highback to the baseplate along a mounting axis, the at least one section being flexibly supported along a flex zone that is generally parallel to the mounting axis.

42. The snowboard binding recited in claim 40, wherein the at least one section is adjustable in a toe-to-heel direction between the first and second fixed shapes.

43. The snowboard binding recited in claim 40, wherein the at least one section is flexible relative to the lower portion of the back member along a flex zone formed in part by at least one aperture extending through the back member.

44. The snowboard binding recited in claim 43, wherein the at least one aperture has a generally oval shape extending across the back member.

45. The snowboard binding recited in claim 39, wherein the highback includes an adjustment mechanism to maintain the at least one section in one of a first fixed position and a second fixed position relative to the lower portion to fix the contoured shape in one of the first fixed shape and the second fixed shape.

46. The snowboard binding recited in claim 45, wherein the adjustment mechanism includes at least one rigid link coupled to the at least one section and the lower portion.

47. The snowboard binding recited in claim 46, wherein at least one end of the link is adjustably connected to the back member.

48. The snowboard binding recited in claim 47, wherein the at least one end of the link is slidably connected to the back member.

49. The snowboard binding recited in claim 46, wherein the adjustment mechanism further includes an actuator mounted to the back member to adjust the at least one section relative to the lower portion.

50. The snowboard binding recited in claim 49, wherein the actuator is connected to the link.

51. The snowboard binding recited in claim 50, wherein the actuator includes a forward lean adjuster adjustably mounted to the lower portion of the back member, a first end of the link being pivotally connected to the at least one section and a second end of the link being connected to the forward lean adjuster.

52. The snowboard binding recited in claim 51, wherein an intermediate portion of the link is adjustably connected to the back member.

53. The snowboard binding recited in claim 46, wherein the adjustment mechanism further includes an interlock between the link and the back member to prevent relative movement therebetween.

54. The snowboard binding recited in claim 38, wherein the at least one section includes a first section having a first shape and a second section having a second shape that is different from the first shape, the first and second sections being interchangeably supported on the back member to adjust the contoured shape between the first and second fixed shapes.

55. The snowboard binding recited in claim 38, wherein the snowboard binding includes at least one adjustable strap mounted to the baseplate to secure a snowboard boot.

56. The snowboard binding recited in claim 38, wherein the snowboard binding is a step-in binding.

57. The snowboard binding recited in claim 38, wherein the highback body further includes a pair of lateral arms extending from opposing sides of the back member for mounting the highback to the component.

58. The snowboard binding recited in claim 57, wherein the back member has an inner surface extending between the opposing sides with a generally concave shape.

* * * * *